US009610763B2

(12) United States Patent
Bauch

(10) Patent No.: US 9,610,763 B2
(45) Date of Patent: Apr. 4, 2017

(54) ADJUSTER FOR PRINTING PRESS

(71) Applicant: SERVOTEC GMBH HERBERT BAUCH, Langenfeld (DE)

(72) Inventor: Herbert Bauch, Burscheid (DE)

(73) Assignee: SERVOTEC GMBH HERBERT BAUCH, Langenfeld (DE)

( * ) Notice: Subject to any disclaimer, the term of this patent is extended or adjusted under 35 U.S.C. 154(b) by 0 days.

(21) Appl. No.: 14/953,131

(22) Filed: Nov. 27, 2015

(65) Prior Publication Data

US 2016/0101615 A1 Apr. 14, 2016

Related U.S. Application Data

(63) Continuation-in-part of application No. 14/354,791, filed on Jul. 17, 2014, now abandoned.

(51) Int. Cl.

| | |
|---|---|
| ***B41F 31/30*** | (2006.01) |
| ***B41F 13/30*** | (2006.01) |
| ***B41F 5/24*** | (2006.01) |

(52) U.S. Cl.

CPC ..... *B41F 31/307* (2013.01); *B41F 13/30* (2013.01); *B41F 31/30* (2013.01); *B41F 31/304* (2013.01); *B41F 5/24* (2013.01)

(58) Field of Classification Search

CPC .. B41F 5/24; B41F 13/30; B41F 31/30; B41F 31/304; B41F 31/307

See application file for complete search history.

(56) References Cited

U.S. PATENT DOCUMENTS

| | | | | | |
|---|---|---|---|---|---|
| 1,288,612 | A | * | 12/1918 | Kaelin | B25B 1/103 269/241 |
| 2,148,800 | A | * | 2/1939 | Billings | B25B 1/103 269/224 |
| 2,614,800 | A | * | 10/1952 | Garlinger | E21B 15/00 187/240 |
| 2,734,410 | A | * | 2/1956 | Gipperich | B25B 1/103 112/114 |
| 3,604,350 | A | | 9/1971 | Rosenstadt | |
| 4,234,177 | A | * | 11/1980 | McDougal | B25B 1/103 269/241 |
| 5,471,929 | A | * | 12/1995 | Rogge | B41F 13/30 101/140 |

FOREIGN PATENT DOCUMENTS

| | | |
|---|---|---|
| DE | 10242009 A | 5/2003 |

* cited by examiner

*Primary Examiner* — Matthew G Marini
*Assistant Examiner* — Leo T Hinze
(74) *Attorney, Agent, or Firm* — Andrew Wilford

(57) ABSTRACT

An adjuster for first and second print rollers carried on respective first and second supports has a first spindle extending along and rotatable about an axis between the supports and formed with a pair of axially spaced screwthreads of the same hand but of different pitches. One of the screwthreads is threaded into the first support and the other into a first nut rotatable about the axis and axially fixed in the second support. A mechanism serves for either arresting the nut against rotation relative to the second support and or rotating the nut relative to the second support.

9 Claims, 3 Drawing Sheets

ADJUSTER FOR PRINTING PRESS

CROSS REFERENCE TO RELATED APPLICATIONS

This application is a continuation-in-part of U.S. patent application Ser. No. 14/354,791 filed 28 Apr. 2014 as the US-national stage of PCT/DE2013/000020 filed 16 Jan. 2013 with a claim to the priority of DE 10 2012 000 752.3 filed 18 Jan. 2012.

FIELD OF THE INVENTION

The present invention relates to an adjuster for a printing press. More particularly this invention concerns an adjuster for the rollers of a printing press.

BACKGROUND OF THE INVENTION

In a printing press, the rollers are each carried on at least one support that is movable linearly on a respective guide.

In printing with such a printing press ink is typically transferred from a print roller onto a substrate or web gripped between the print roller and a counter-pressure roller. Flexographic printing is basically performed by three rollers. An anilox roller transfers ink to a printing roller whose textured surface holds the ink and prints the ink onto a substrate sandwiched between the print roller and a counter-pressure roller. Flexographic printing can be performed with a wide range of water- or oil-base inks, and prints well on a variety of different substrate materials like plastic, foil, acetate film, paper, tissue, and other similar materials.

Adjustment of the rollers is important for the operation of a printing press. Typically two adjustment modes are used:

1. Coarse adjustment in which the rollers are moved at high speed in order to achieve a fast clearance that could be used for a change of formats on the printing roller or for maintenance.

2. Fine adjustment of the rollers necessary for precise movement in order to optimize the printing quality for example with a different substrate.

U.S. Pat. No. 3,604,350 provides a solution for a coarse and fine adjustment of a roller of a flexographic printing press where the coarse adjustment is effected by a pair of gears mounted on a transverse movable gear shaft. For coarse adjustment, the shaft is moved into a position where the gears engage a rack on a support of a roller, in this position rotation of the shaft imparts fast movement to the roller. For fine adjustment, the shaft is moved into a position where the gears are not engaged with the rack and movement of the rollers is only performed by spindles extending parallel to the movement direction of the roller.

Another solution for a combination of coarse and fine adjustment is published in the German application DE 102 42 009. It describes a printer with spindles that are parallel to the movement direction of the roller and engageable with gears mounted on motor-driven shafts. For coarse adjustment the shaft is moved into a position in which the gears are engaged with the spindles and automatic rotation of the motor driven shaft provides fast movement of the roller. Fine adjustment is performed by manual rotation of the spindles with the shaft positioned such that the gears are disengaged from the spindles.

Disadvantages of the existing solutions for coarse adjustment are additional drives or actuators, force transfer, bearing, and coupling elements. In addition, no sufficient precise predetermining of individual formats and no simultaneous automatic and manual operation are possible. The required space and the construction costs of the known solutions for additional coarse adjustment are also very substantial. The necessary special adaptation to circumstances, in other words the lack of universality, is another shortcoming of the known solutions.

OBJECT OF THE INVENTION

For this reason, the object of the invention is to find a universal solution with minimal construction costs and the least amount of required space, and that can be manually driven or motor-driven, and at the same time is very rigid and not sensitive to external influences such as dirt.

SUMMARY OF THE INVENTION

The adjuster according to the invention is used with first and second print rollers carried on respective first and second supports and has a first spindle extending along and rotatable about an axis between the supports and formed with a pair of axially spaced screwthreads of the same hand but of different pitches. One of the screwthreads is threaded into the first support and the other into a first nut rotatable about the axis and axially fixed in the second support. A mechanism serves for either arresting the nut against rotation relative to the second support and or rotating the nut relative to the second support.

In other words, the object of the invention is attained with an adjuster having at least two rollers each carried on a respective support that is movable in a straight line on a respective guide. The spacing between the rollers is determined by spindles that have at least two screwthreads of the same hand but with slightly different pitches. One of the screwthreads is threaded into one of the supports and the other into a nut carried on the other of the supports.

The use of at least one spindle that has at least two screwthreads of the same hand but slightly different pitch in combination with at least one nut rotatable mounted to one of the support and optionally rotationally locked to the spindle or in the support enables one to perform coarse and fine adjustment of a roller by rotation of the spindle.

For coarse adjustment of the rollers one of the screwthreads engages a nut rotatable in a bearing in the second support while the other screwthread directly engages the first support. Rotation of the spindle has no significant impact on the axial movement of the second support in which the nut is rotatable in a bearing, because the force applied by the screwthread is mainly transformed into rotation and not to axial movement of the nut. Since the nut is rotatable mounted in the bearing the corresponding second support is not moving axially. In contrast rotation of the spindle causes axial movement of the respective first support. Therefore, relative axial movement between both supports depends on the pitch of the screwthread that is engaged with the first support.

For fine adjustment of the roller the nut is rotationally locked to its respective support. Rotation of the spindle in this rotationally locked nut leads to relative axial movement of the spindle to a second support in which the nut is rotationally locked. The corresponding first support, which can move relative to the second on a longitudinal linear bearing, is forced to move axially because the rotation of the screwthread of the spindle is transformed into the axial movement by the other screwthread threaded in its support. Since the screwthreads are of the same hand, the motion of the support is opposite to the axial movement of the spindle. The relative movement between both supports is then defined by the difference between the pitches of the screwthreads.

An adjuster according to this invention has the advantage that a coarse and fine adjustment between two rollers could be effected on both axial ends with a single spindle and at least one nut that is rotationally locked to the spindle or in the support. This enables a very compact solution without additional force-transferring devices, like gears or shafts. Due to the small number of mechanical elements this concept provides also a solution with low maintenance requirements. Since the relative movement between the rollers only depends on the difference between the pitches the screwthreads it is also possible to achieve very precise movement, even with screwthreads that have a large pitch.

In one form of the invention, the adjuster is used in a printing press that has three press rollers on respective relatively movable supports, namely a counter-pressure roller on a frame, a printing roller on a slide and an anilox roller on a support.

The implementation of the adjuster in a printing press with three press rollers on at least three supports components has the advantage that the positions of the rollers could be adjusted with devices that have a compact and maintenance friendly design.

An embodiment of the invention that could be preferably used for flexographic printing has at least one spacing determining spindle between the support and the slide and having at least one spacing determining spindle between the frame and the slide, and the nuts are rotatable mounted to the slide in bearings and the screwthreads seated in the support and in the frame.

In this way the embodiment of the invention provides a fine adjustment of the spacing between the printing roller on the slide and the anilox roller on the support, which defines the amount of ink that is transferred from anilox roller to the printing roller. Also the spacing between printing roller and the counter-pressure roller on the support could be precisely adjusted in order to define the pressure exerted on the substrate between both rollers. In addition this configuration provides a coarse adjustment of the spacing between the anilox roller and the printing roller as well as between the printing roller and the counter pressure roller. Since both bearings are on the slide on which the printing roller is journaled, the printer roller represents the reference point for the movement of the anilox roller and the counter pressure roller.

This embodiment of the invention has the advantage that the spacing between printing roller and the anilox and counter-pressure roller could be adjusted in a very precise way in order to control the printing quality by regulation of the transferred ink and the applied pressure on the substrate. Furthermore it allows a quick release of the printing roller for example for a change of formats or maintenance.

According to an advantageous embodiment of the adjusters, at least one of the nuts is rotationally lockable to the spindle by a first clamp or to the respective support by a second clamp.

According to this embodiment the nut can be rotationally fixed to the spindle or to the bearing for defined movement in the coarse adjustment mode because axial movement of the spindle relative to the nut, respective bearing and support, is restricted when the nut is rotationally locked to the spindle. Without the rotational locking between the spindle and the nut a part of the rotation of the spindle could be transformed into axial movement of the spindle due to the frictional resistance during the rotation in the bearing. Clamping levers could be preferably used in order to lock the nut to the spindle or to the bearing.

This embodiment of the invention has the advantage of improved precision of the adjuster because a marginal axial movement of the spindle relative to the support on which the nut is rotatable mounted is restricted. In particular it improves reproducibility of the adjuster, especially when switching between coarse and fine adjustment.

A further embodiment of the invention foresees that the nut is slotted and the adjuster further has means for biasing the nut axially.

Another similar embodiment of the invention is to provide the adjuster with nuts that are split transversely into at least two parts and the adjuster is provided with biasing means for urging the parts axially away from each other.

In this way both parts of the nut are pressed against the screwthread. Due to this configuration play between the nut and the screwthread is avoided.

The benefit of this embodiment of this invention is a durable precise movement of the printing rollers because play between nuts and spindle due to material wear can be compensated for. A durable spacing adjustment between the printing rollers enables good printing quality, especially for long lasting operations.

Another embodiment of the invention has a longitudinal force-generating element that is between the supports. This longitudinal force-generating element introduces a longitudinal force that pushes the supports apart or pulls them together. This longitudinal force-generating element could for example be a pneumatic, mechanic or electric actuator that is between the supports. In a preferred arrangement the longitudinal force-generating element is between slide and the support and/or between the slide and the frame.

This embodiment also has the benefit that durable precise movement of the printing rollers is effected because play between the nuts and the spindle due to material wear is compensated for. The defined spacing between slide and the support and/or between the slide and the frame enables good printing quality, especially for a long service life in the flexographic printing presses.

In a preferred embodiment of the invention the nut is rotationally drivable by an actuator. According to the presented invention drivable nuts provide another technical option to realize an adjuster for a roller with the coarse and fine adjustment.

For coarse adjustment the nut is rotatable in the bearing of a second support and rotationally locked to the spindle. The other screwthread is rotationally engaged in a first support. In this configuration rotation of the rotatable nut leads to rotation of the spindle without a transfer of longitudinal force to the corresponding second support. Due to the rotation of the spindle a longitudinal force is applied to the first support. In this case the relative movement between the supports is only determined by the pitch of the screwthread threaded into one of the supports.

For fine adjustment the driven nut is rotatable in a second support and also not rotationally locked to the spindle. The other screw thread is rotationally engaged in a first support. In this configuration the rotation of the drivable nut leads to axial movement of the spindle relative to the nut. At the same time the rotation of the spindle forces the first support to move axially. Due to the screwthreads of the same hand the motion of the first support is opposite to the axial movement of the spindle. The relative movement between both supports is than defined by the difference between the pitches of the screwthreads.

The adjuster according to this embodiment of the invention has the advantage that a coarse and fine adjustment could be easily effected by rotation of the nut, which is optionally rotationally locked to the spindle or in the bearing of a support. This solution enables a very compact adjuster with a minimum number of mechanical drive elements.

In a preferred embodiment of the invention the nut is rotationally driven by an actuator through a drive element. The drive element enables rotation of the nut by an actuator that is not directly connected with the nut. Preferably all of the nuts are rotationally drivable connected to a single actuator by a drive element in order to drive all spindles by only one actuator.

This solution has the advantage that only one actuator is necessary to drive all the spindles. Also the use of one actuator that is connected to all nuts by the same drive element ensures that all the spindles perform the same rotation. If the positioning of one roller depends on more than one spindle the same movement of the spindles ensures that the roller is precisely adjusted over its whole longitudinal length and not canted.

In one embodiment of the invention all of the nuts are rotationally connected to a manual drive section by a drive element. In this way all the spindles are manually driven by an actuator or drive. The benefit of this embodiment is that one actuator or drive could move all spindles in the same way at the same time. This enables precise adjustment over the whole length of the roller.

In a preferred embodiment of the invention the drive element that connects the actuator or the manual drive section with the rotatable nuts is a drive belt or chain.

By using a drive belt or drive chain rotation of the actuator or the manual drive section is directly transformed into rotation of the nuts. Especially the drive chain or the drive belt makes it possible to connect several nuts to one actuator with only one drive belt or chain. This provides the advantage that a connection of several nuts with an actuator or a manual drive could be effected in a very simple and effective way.

In a preferable embodiment of the invention the first clamp and/or the second clamp of each nut is automatically switchable. Automatically switchable clamps enable the automatic switching between coarse and fine adjustment. For fine adjustment the corresponding nut is not rotationally locked to the spindle and in the bearing. In contrast for the course adjustment the nut is rotationally locked to the spindle but not to the bearing.

Automatically switchable clamps have the advantage that the adjuster of a roller could be automatically switched between coarse and fine adjustment. This provides a very simple and compact solution for the automatic adjustment of a roller, especially for flexographic printing presses.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
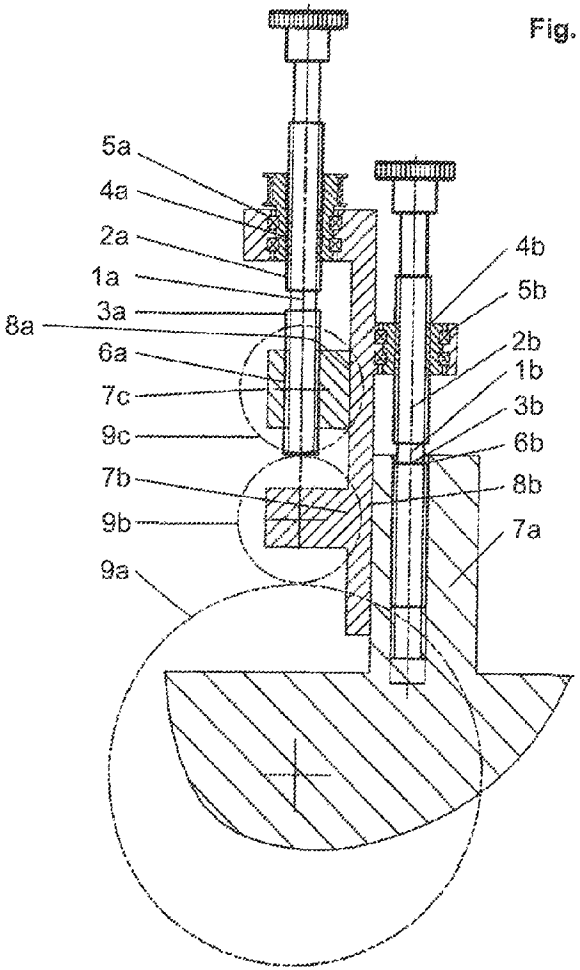
FIG. 1 is a side view of the adjuster for a roller constructed according to the invention.

As seen in FIG. 1, a counter pressure roller 9*a*, a print roller 9*b*, and an anilox roller 9*c* are carried on respective first, second, and third supports 7*a*, 7*b*, 7*c* for rotation about respective parallel and normally horizontal axes. First and second spacing-setting spindles 1*a* and 1*b* rotatable about respective parallel and vertical axes each have two respective screwthreads 2*a*, 3*a* and 2*b*, 3*b* of the same hand but slightly different pitches. The screwthreads 2*a* and 2*b* are each engaged in a respective nut 4*a* and 4*b* that is rotatable in a respective bearing 5*a* and 5*b* of the second support 7*b* that is carried on a guide 8 of the first support 7*a* for straight-line or linear vertical movement. The other screwthreads 3*a* and 3*b* are engaged in respective screwthreads 6*a* and 6*b* integrated in the first or third support 7*a* or 7*c*, respectively. The same adjuster mechanism is also on the opposite ends of the rollers 9*a*, 9*b*, and 9*c*.

In order to adjust the spacing between the third anilox roller 9*c* and the second print roller 9*b*, the spindle 1*a* is axially coupled to the second slide support 7*b* and can rotate in the third support 7*c*.

For fine adjustment of both supports 7*b* and 7*c* the nut 4*a* is rotationally locked to the bearing 5*a* of the slidable second support 7*b*. In this mode the screwthread 6 is also firmly connected to the support 7*c*. Rotation of the spindle 1*a* leads to axial movement of the spindle 1*a* relative to the slidable second support 7*b* while the support 7*c* is moving in the opposite direction due to the identical orientation of the screwthreads 2*a* and 3*a*. A slightly different pitch of the screwthreads 2*a* and 3*a* leads to a small relative movement between both supports 7*b* and 7*c*.

For coarse adjustment the nut 4*a* is not rotationally fixed in the bearing 5 and is therefore rotatable in the slidable second support 7*b*. The screwthread 6 is rotationally locked to the support so that rotation of the spindle 1*a* leads to a movement of the support 7*c* relative to the spindle 1*a*. Since the nut 4 is rotatable in the second support 7*b* the relative position between the slidable second support 7*b* and the spindle 1*a* does not change on rotation of the spindle 1*a*. As result the whole displacement is determined by the screwthread 3*b*, so that the movement effected by one rotation is significantly larger than in fine adjustment mode.

According to a preferred embodiment of the invention one press roller is rotatable mounted to supports, and the position of the press rollers is given by the position of the supports. A typical flexographic printing press setup has three press rollers, namely the counter-pressure roller 9*c*, the print roller 9*b* and the anilox roller 9*a*. In a preferred version of this invention the spacing between the print roller 9*b* and anilox roller 9*c* is determined by at least one spindle 1*a* connected by the screwthread 2*a* with the nut 4*a* in the slidable second support 7*b* and by the screwthread 3*a* threaded into the support 7*c*. In addition the spacing between the counter-pressure roller 9*a* and the print roller 9*b* is determined by at least one spindle 1*b* engaged with screwthread directly to the support 7*a* and by the screwthread 2*b* to the nut 4*b* in the slidable second support 7*b*. In this configuration the nuts 4*a* and 4*b* are rotatable in the respective bearings 5*a* and 5*b* of the second support 7*b* carrying the middle print roller 9*b*.

There are thus five possible modes:

1. Fine adjustment with a driven spindle

Nut 4*a* locked to the support 7*b*

Nut 4*a* not locked rotationally to the spindle 1*a*

Result: Rotation of the spindle 1*a* will shift the support 7*c* relative to the support 7*b* at a rate determined by the difference between the pitches of the screwthreads 2*a* and 3*a*.

2. Coarse Adjustment with a driven spindle

Nut 4*a* not locked rotationally to the support 7*b*

Nut 4*a* not locked rotationally to the spindle 1*a*

Result: The displacement rate of the support 7*b* will be determined solely by the coarse pitch of the screwthread 3*a*. The spindle 1*a* will not move axially because of the friction of the bearing seat 5*a* and the friction resistance of the spindle 1*a* in the nut 4*a* is much higher than the friction of the nut 4*a* to the support 7*b*. This mode depends on pitch, friction, and other factors. But the impact of these factors is negligible. Especially, the impact is negligible for the coarse adjustment where a high precision is not needed.

3. Coarse Adjustment with a driven spindle

Nut 4*a* not locked rotationally to the support 7*b*

Nut 4*a* locked rotationally to the spindle 1*a*

Result: The displacement rate of the support 7*b* will be determined solely by the coarse pitch of the screwthread 3*a*. The spindle 1*a* will not move axially.

4. Fine adjustment with a driven nut

Nut 4*a* not locked rotationally to the support 7*b*

Nut 4*a* not locked rotationally to the spindle 1*a*

Result: Since the nut 4*a* is not locked to the spindle 1*a*, rotation of the nut 4*a* leads to rotation of the spindle 1*a*. Since the nut 4*a* is axially fixed in the support 7*b*, the spindle moves axially. Rotation of the spindle 1*a* will shift the support 7*c* relative to the support 7*b* at a rate determined by the difference between the pitches of the screwthreads 2*a* and 3*a*.

5. Coarse adjustment with a driven nut

Nut 4*a* not locked rotationally to the support 7*b*

Nut 4*a* locked rotationally to the spindle 1*a*

Result: the spindle 1*a* is not allowed to rotate and the nut 4*a* is driven (e.g. by the drive 15 of FIG. 6), so the support 7*c* will be moved at a rate purely determined by the finer pitch of the screwthread 2*a*. The spindle 1*a* will not move at all.

Figure 2:
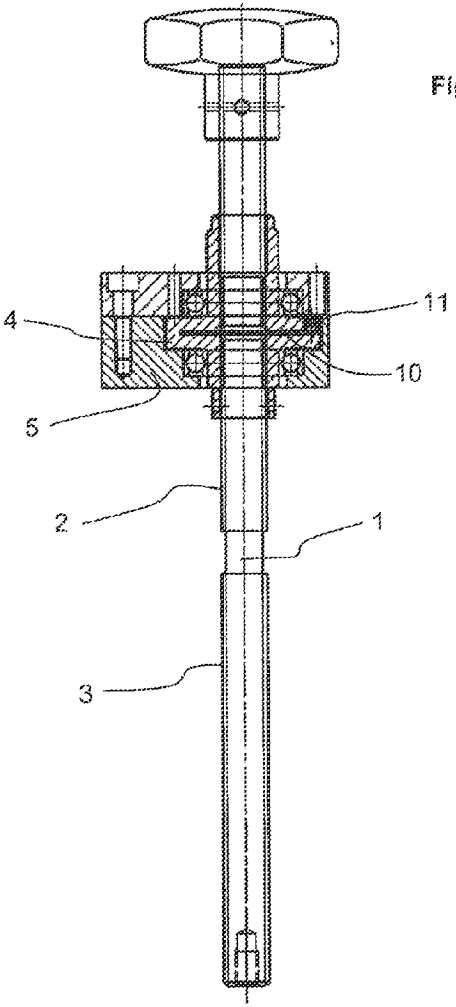
FIG. 2 is an enlarged sectional view of a slotted nut in a bearing.

FIG. 2 is a detailed sectional view of a spindle 1 and a nut 4. The nut 4 is engaged to a screwthread 2 and can rotate but not move axially in a bearing 5. In order to bias the nut 4 toward the spindle 1, the nut 4 is formed with a transverse slot 10. The nut 4 is biased toward the spindle 1 by a biasing unit 11 that pushes the parts of the nut 4 separated by the slot apart and clamps the nut 4 in the bearing 5. The biasing means 11 could for example be a screw, a pneumatic element or electro-mechanical clamp.

Figure 3:
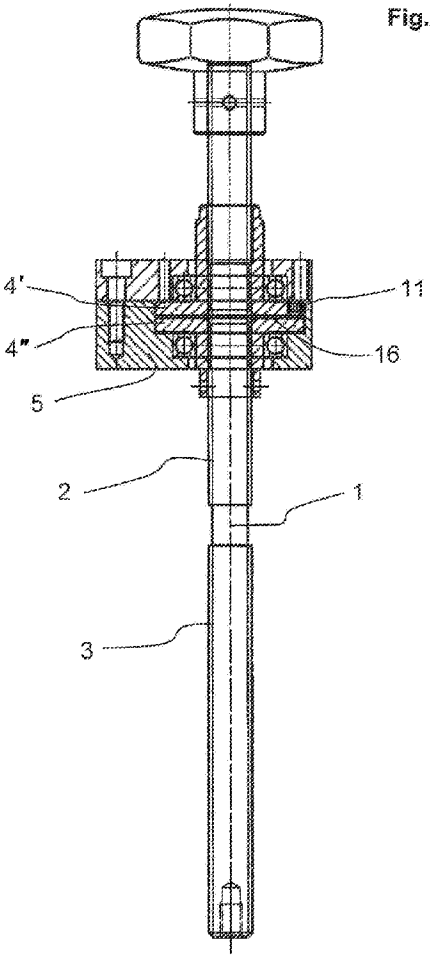
FIG. 3 is an enlarged sectional view of a split nut in a bearing.

FIG. 3 shows another version of a nut 4 that is rotatable in a bearing 5. In this embodiment of the invention the nut 4 is split into an upper part 4' and a lower part 4" separated by a gap 16.

In this preferred embodiment of the invention the upper part 4' of the split nut and the lower part 4" of the split nut 4*b* are pushed in axially opposite directions by a biaser 11. This compensates for wear of the nut and/or screwthreads and minimizes the clearance between the nuts 4*a* and 4*b* and the respective screwthreads 2*a* and 2*b*.

Figure 4:
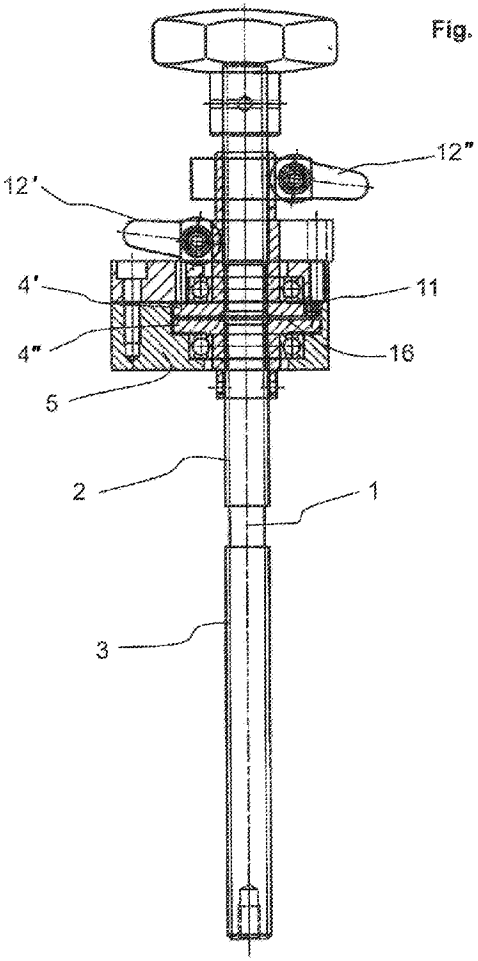
FIG. 4 is an enlarged sectional view of a nut that is firmly seatable to a spindle or a bearing.

A preferred embodiment of the invention is shown in FIG. 4, wherein the nut 4 is split into two parts, the upper part 4' and the lower part 4" and set in the bearing 5. In this embodiment of the invention the nut could be rotationally locked to the bearing 5 by a first clamp 12'. Furthermore, the nut 4 could be rotationally locked to the spindle 1*a* by a second clamp 12". This embodiment of the invention makes it possible to firmly rotationally fix the nut 4 in the bearing 5 or in the spindle 1*a*.

Figure 5:
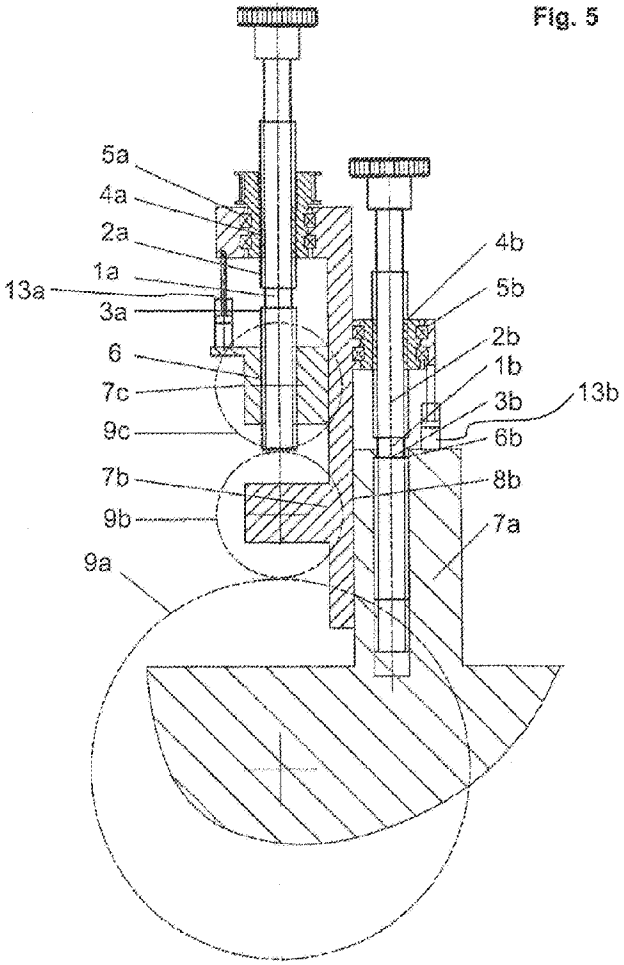
FIG. 5 is an enlarged sectional view of the adjuster of a roller with a longitudinal force-generating element.

FIG. 5 shows another embodiment of the invention in which a longitudinal force-generating element 13 is provided between the supports 7*b* and 7*c*. This longitudinal force-generating element 13 pushes the supports apart or pulls them together in order to reduce clearance between the nuts 4*a* and 4*b* and the corresponding screwthreads 2*a*, 2*b*, 3*a*, and 3*b*. Due to this longitudinal force-generating element 13 wear of the screwthread or nut material is compensated for and precise adjustment or positioning of the supports 7 is ensured. The longitudinal force-generating element 13 is for example a mechanical cylinder, electro-mechanical cylinder or pneumatic cylinder.

In a preferred embodiment of the invention a longitudinal force-generating element 13 is provided between the slidable second support 7*b* and the support 7*c* and between the slidable second support 7*b* and the support frame 7*a* so that a precise positioning between counter-pressure roller 9*a* and print roller 9*b* and between print roller 9*b* and anilox roller 9*c* could be effected.

Figure 6:
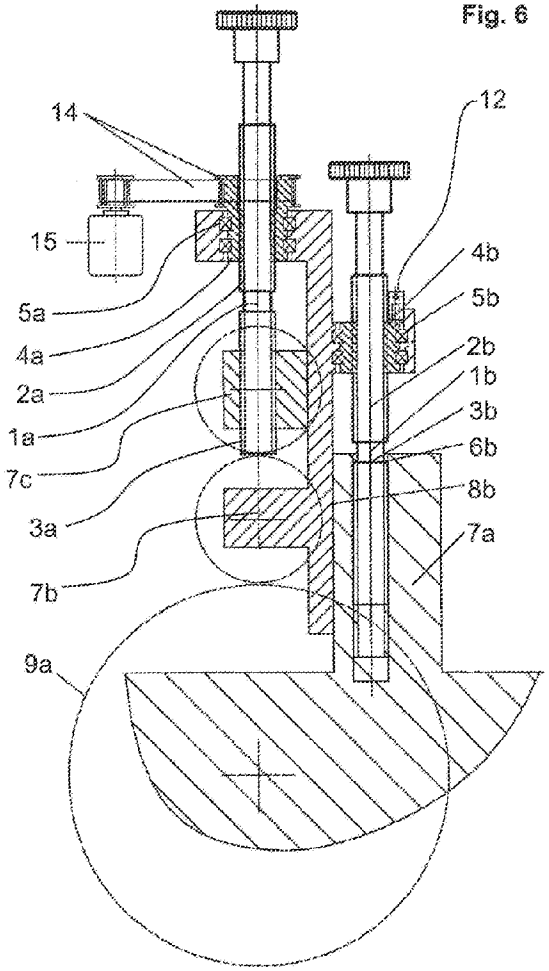
FIG. 6 is the sectional view of the adjuster for a roller in which the nut is connected to an actuator by a drive element.

A user-friendly embodiment of the invention is shown in FIG. 6, where a nut 4*a* is rotated about the axis of the spindle 1*a* by a drive or actuator 15. In this embodiment of the invention coarse adjustment is effected when the nut 4*a* is rotationally locked to the spindle 1*a* and rotatable in the bearing 5*a*. In this case rotation of the nut 4*a* leads to rotation of the spindle 1*a* while due to the rotational connection between the spindle 1*a* and the nut 4*a* the spacing between the spindle 1 and the slidable second support 7*b* does not change. But the rotation of the spindle 1*a* leads to linear movement of the support 7*c* that is moving with respect to the slidable second support 7*b*. In this mode movement depends only on the pitch of the screwthread 2*a* or of the screwthread 3*a*.

In this embodiment fine adjustment is effected when the nut 4*a* is rotatable in the bearing 5*a* and also not rotationally fixed to the spindle 1*a*. In this mode rotation of the nut 4*a* leads to a linear movement of the spindle 1*a* relative to the slidable second support 7*b* that is determined by the pitch of screwthread 2*a*. At the same time the support 7*c* is moving into longitudinal direction due to the rotation of the spindle 1*a*. The identically orientated screwthreads 2*a*, 3*a* lead to an opposite movement of the support 7*c*. The resulting movement is than determined by the difference of the pitch of the screwthreads 2*a*, 3*a* and therefore very precisely tunable.

The nut 4*a* is rotationally drivable connected to an actuator 15 by a drive element 14 in another preferred embodiment of the invention. This drive element is for example a belt, a chain or a combination of gears.

In a preferred version of the invention the spacing between the two supports 7*b* and 7*c* is determined by two spindles 1*a* that are both driven by one actuator 15 rotationally drivable connected by a drive element 14. In this way one actuator 15 could be used to adjust the positions of the rollers 9*b* and 9*c* along their longitudinal axes.

Another embodiment of the invention that is not shown in FIG. 6 has all of the nuts 4*a* rotationally driven by a single actuator 15 and drive element. This drive element is for example a drive belt, a drive chain or a set of drive gears. This embodiment of the invention provides the option to move all spindles 1 and therefore, all the rollers by only one actuator 15.

In an embodiment of the invention that is not shown in the figures. all of the nuts 4*a* are rotationally connected to a single actuator 15 by a drive element 14 and all of the nuts 4*a* are rotationally fixed on the spindle 1*a* by a first clamping lever 12*b* or in the bearing 5 by a second clamping lever 12*a*. With this embodiment of the invention it is possible to drive all the spindles 1 with a single actuator 15 and automatically switch each spindle 1*a* between coarse or fine adjustment.

An adjuster or a roller according to this invention provides a solution with minimal construction costs and required space, that can be manually or motor driven to enable an easy change between coarse and fine adjustment.

I claim:

1. In combination with first and second print rollers carried on respective first and second supports, an adjuster comprising:

a first spindle extending along and rotatable about a first axis and formed with a pair of axially spaced screwthreads of the same hand but of different pitches, one of the screwthreads being threaded into the first support;

a first nut rotatable about the first axis, axially fixed in the second support, and threaded onto the other of the screwthreads;

means for arresting the first nut against rotation relative to the second support; and means for rotating the first nut relative to the first spindle.

2. The press-roller adjuster defined in claim 1, further comprising:

a third roller having a respective third support;

a second spindle extending along and rotatable about a second axis and formed with a pair of axially spaced screwthreads of the same hand but of different pitches;

one of the screwthreads of the second spindle being threaded into the third support;

a second nut rotatable about the second axis, axially fixed in the second support, and threaded onto the other of the screwthreads of the second spindle; and means displaceable between a holding position for arresting the second nut against rotation relative to the second support or the second spindle and a release position permitting such rotation.

3. The press-roller adjuster defined in claim 2, further comprising:

a longitudinal force-generating element between the first and second supports or between the second and third supports.

4. The press-roller adjuster defined in claim 1, further comprising:

a longitudinal force-generating element between the first and second supports.

5. The press-roller adjuster defined in claim 1, further comprising:

an actuator rotating the first nut.

6. The press-roller adjuster defined in claim 5, further comprising:

a drive element connecting the actuator to the first nut.

7. The press-roller adjuster defined in claim 6, wherein the drive element is a belt, a chain, or a set of gears.

8. In combination with first and second print rollers carried on respective first and second supports, an adjuster comprising:

a first spindle extending along and rotatable about a first axis and formed with a pair of axially spaced screwthreads of the same hand but of different pitches, one of the screwthreads being threaded into the first support;

a first slotted nut rotatable about the first axis, axially fixed in the second support, and threaded onto the other of the screwthreads;

means for arresting the first nut against rotation relative to the second support;

means for rotating the first nut relative to the first spindle; and means for biasing the first nut axially.

9. In combination with first and second print rollers carried on respective first and second supports, an adjuster comprising:

a first spindle extending along a first axis, rotatable about the first axis, and formed with a pair of axially spaced screwthreads of the same hand but of different pitches, one of the screwthreads being threaded into the first support;

a first nut rotatable about the first axis, axially fixed in the second support, and split transversely into at least two parts and threaded onto the other of the screwthreads;

means for arresting the first nut against rotation relative to the second support by relatively axially moving the parts;

means for rotating the first nut relative to the first spindle; and means for biasing the parts axially away from each other.

* * * * *